US010519023B2

(12) United States Patent
Qiu

(10) Patent No.: US 10,519,023 B2
(45) Date of Patent: Dec. 31, 2019

(54) LIQUID CONTAINER

(71) Applicant: Dilin Qiu, Yuhuan (CN)

(72) Inventor: Dilin Qiu, Yuhuan (CN)

(73) Assignee: Saifei You, Yuhuan (CN)

( * ) Notice: Subject to any disclaimer, the term of this patent is extended or adjusted under 35 U.S.C. 154(b) by 0 days.

(21) Appl. No.: 16/108,124

(22) Filed: Aug. 22, 2018

(65) Prior Publication Data

US 2019/0062139 A1 Feb. 28, 2019

(30) Foreign Application Priority Data

Aug. 24, 2017 (CN) ..... 2017 1 0735013

(51) Int. Cl.

| | |
|---|---|
| ***B67D 1/04*** | (2006.01) |
| ***B65D 77/06*** | (2006.01) |
| ***B67D 1/06*** | (2006.01) |
| *B67D 1/00* | (2006.01) |
| *B67D 1/12* | (2006.01) |

(52) U.S. Cl.

CPC ..... *B67D 1/0462* (2013.01); *B65D 77/06* (2013.01); *B67D 1/0412* (2013.01); *B67D 1/06* (2013.01); *B65D 2205/00* (2013.01); *B67D 1/0001* (2013.01); *B67D 1/1279* (2013.01)

(58) Field of Classification Search

CPC ..... B67D 1/0462; B67D 1/0001; B67D 1/06; B67D 1/0412; B67D 1/1279; B67D 2205/00; B65D 77/06

See application file for complete search history.

(56) References Cited

U.S. PATENT DOCUMENTS

| | | | | |
|---|---|---|---|---|
| 2,543,585 A * | 2/1951 | Miller | F15B 1/10 138/30 |
| 3,230,975 A * | 1/1966 | Mercier | F15B 1/10 138/30 |
| 3,838,794 A * | 10/1974 | Cogley | A61J 1/10 222/95 |
| 6,045,006 A * | 4/2000 | Frazier | B65D 77/065 222/105 |
| 7,887,238 B2 * | 2/2011 | Turvey | B65D 33/01 383/103 |

(Continued)

FOREIGN PATENT DOCUMENTS

| | | |
|---|---|---|
| CN | 200780027336 | 2/2012 |
| CN | 201610222402 | 7/2016 |
| CN | 201621195468 | 5/2017 |

*Primary Examiner* — J C Jacyna
(74) *Attorney, Agent, or Firm* — Minder Law Group; Willy H. Wong

(57) ABSTRACT

A liquid container comprises an outer casing, a flexible inner bag disposed in the outer casing, and a liquid outlet valve. The inner bag is fixedly connected to the valve and a bag opening of the inner bag forms a seal with the liquid outlet valve. The outer casing forms a seal with the valve and one end of the outer casing connected to the valve is further connected with a ventilation structure. A flexible separation bag is further sleevely disposed between the inner bag and the outer casing, and has a plurality of convex portions protruding from a surface of the separation bag, and each of the convex portions extends from a bag opening of the separation bag toward a direction away from the bag opening of the separation bag. A first auxiliary air passage is formed between the two adjacent convex portions.

10 Claims, 10 Drawing Sheets

(56) References Cited

U.S. PATENT DOCUMENTS

| | | | | |
|---|---|---|---|---|
| 9,714,163 | B2 * | 7/2017 | Standaert | B67D 1/0418 |
| 2014/0252029 | A1 * | 9/2014 | Kallgren | B67D 1/0462<br>222/95 |
| 2018/0244428 | A1 * | 8/2018 | Standaert | B32B 5/02 |

* cited by examiner

A

LIQUID CONTAINER

RELATED APPLICATIONS

This application claims priority to China Patent Application No. 2017107350137 filed Aug. 24, 2017.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention belongs to the technical field of machinery and relates to a container, and more particularly to a liquid container.

Related Art

There are many kinds of liquid containers on the market, such as wine barrels, which are tools for holding liquor. The barrel opening of general wine barrels is disposed with a wine spear, and the wine spear cooperates with a dispenser to achieve pressing out the liquor inside the wine barrel. At present, the wine barrels commonly used in the market are hard metal wine barrels. The hard metal wine barrels can resist the high pressure generated by the internal gas and provide sufficient strength to ensure that they will not break due to expansion. However, this type of metal wine barrel has high cost and is troublesome to clean. General merchants do not have a device for cleaning metal wine barrels. Therefore, after the liquor in the wine barrel is used up, the empty wine barrel needs to be transported to the manufacturer for cleaning, and this increases the cost of transporting back and forth. In response to the above problems, currently, some wine barrel manufacturers have made some improvements. For example, the metal outer casing of the wine barrel is replaced with a plastic outer casing, the plastic outer casing is relatively light, and the cost is also much lower. But at the same time, it has relatively higher strength to meet the requirements of use, and is very suitable for use as a disposable wine barrel, so it is not necessary to transport the empty wine barrel to the manufacturer for cleaning after use.

For example, one prior art wine barrel comprises a barrel body, and a wine spear head and a guide sleeve are disposed at a barrel opening of the barrel body, a connector is inserted into the guide sleeve, and a flexible bag is connected to a lower end of the connector. The wine spear head and the barrel opening of the barrel body are connected by thread or snap connection, the guide sleeve is insertedly connected and positioned in the barrel opening of the barrel body, and the connector can move up and down in the guide sleeve. An air intake passage is formed between the wine spear head, the guide sleeve and the connector, and the air intake passage communicates with the inside of the barrel body when the connector moves downward. A limit member for restricting the downward movement distance of the connector in the guide sleeve is connected on the connector, and a bottom of the connector is disposed with a pressure cap connected with the connector thread. There is a wine outlet passage in the connector, and the inside of the pressure cap is disposed with a valve element capable of opening or closing the wine outlet passage.

Although the wine barrel is convenient to use and light in weight, in the process of filling wine into a wine bag, take into consideration in preventing the inner bag from being broken, it is necessary to invert the entire wine barrel for filling, that is, the barrel opening of the wine barrel is set downwardly. As the inner bag is continuously filled with liquor, under the gravitational effect of the liquor, the inner bag at the barrel opening position of the wine barrel is first expanded and fitted against an inner wall of the wine barrel. A ventilation passage on the wine spear is immediately blocked by the expanded inner bag, and the gas originally existing between the inner bag and the wine barrel cannot be discharged in time. As more and more liquor is being filled, the originally existing gas between the inner bag and the wine barrel is continuously being compressed. Finally, it is accumulated at the entire bottom of the wine barrel, which is the top position at the time of filling. At this time, the air pressure of the compressed gas is extremely high and the inner bag is continuously being pressed, so that It is no longer possible to continue fill the liquor into the inner bag from the outside, resulting in the space in which the liquor can still be stored originally is wasted, and causing a relatively low space utilization rate of the beer barrel during filling and a relatively low filling volume.

In the prior art, there are also some liquid containers that attempt to add a sheet-like or rod-shaped exhaust structure for assisting in discharging gas between the outer barrel and the inner bag. However, if the exhaust structure has a certain hardness, although the exhaust structure can maintain its original shape and smoothly extend to a middle or bottom portion of the outer barrel after the entire liquid container is inverted; but when the inner bag is continuously filled with liquid and expanded, the hardness of the exhaust structure can easily cause puncture or damage to the flexible inner bag, resulting in leakage, etc., and therefore the liquid cannot be smoothly stored. If the exhaust structure is too soft, it will easily fold or collapse caused by gravitational effect or rubbing and pressing of the inner bag during the expansion process of the inner bag; so that the exhaust structure is still piled up in a neck of the outer barrel, the gas at the bottom is still not discharged, the bottom space where the liquid can be stored originally is still wasted. Therefore, the filling volume of the liquid container cannot be effectively increased in the prior art.

SUMMARY OF THE INVENTION

One object of the present invention is to provide a liquid container in view of the above problems in the prior art, and the technical problem to be solved by the present invention is how to increase the filling volume of the liquid container.

One object of the present invention can be achieved by the following technical solutions:

One embodiment of a liquid container comprises a barrel-shaped outer casing, a flexible inner bag disposed in the outer casing for storing liquid, and a valve for controlling the fluid to flow in/out of the inner bag. The inner bag is fixedly connected to the valve and a bag opening of the inner bag forms a seal with the valve. The outer casing forms a seal with the valve and one end of the outer casing connected to the valve is further connected with a ventilation structure capable of controlling gas to flow in/out of the outer casing. Wherein a separation bag is further sleevely disposed between the inner bag and the outer casing to sleeve an outside of the inner bag, the separation bag is a flexible bag, the separation bag has a plurality of convex portions protruding from a surface of the separation bag, each of the convex portions extends from a bag opening of the separation bag toward a direction away from the bag opening of the separation bag, a first auxiliary air passage for gas circulation is formed between the two adjacent convex portions, and the first auxiliary air passages are always in communication with the ventilation structure.

One embodiment of a liquid container comprises the outer casing, the inner bag and the separation bag. When the liquid container is inverted and liquid is filled into the inner bag, as the liquid is continuously filled into the inner bag, under the gravitational effect of the liquid, the inner bag and the separation bag at the position of a barrel opening of the outer casing are both first expanded and attached to an inner wall of the outer casing. As more and more of the liquid is being filled, the gas originally present between the separation bag and the outer casing is further discharged to the outside of the liquid container through the first auxiliary air passages communicated with the ventilation structure.

One embodiment of the present invention separately disposes the flexible separation bag between the outer casing and the inner bag, so that the convex portions can be conveniently processed without affecting the structure and strength of the inner bag itself. In the process of filling the liquid into the inner bag, the separation bag is gradually expanded by the inner bag to fit on the inner surface of the outer casing, and since the ventilation structure is disposed at the same end of the liquid container with the liquid outlet valve, it is easily blocked by the expanded separation bag. However, the convex portions are disposed on the separation bag, ensuring that the first auxiliary air passages formed between the convex portions can communicate with the ventilation structure, and the convex portions extend from the bag opening of the separation bag toward a direction away from the bag opening of the separation bag to ensure communication between the ventilation structure and the space away from the ventilation structure. Even if the separation bag is stretched to fit on the inner surface of the outer casing, the ventilation structure is not further blocked. A portion of the gas located in the outer casing can still flow to the ventilation structure along the first auxiliary air passages and be discharged outside the liquid container, so as to ensure that the liquid is not compressed by the high pressure gas and can be further filled into the inner bag, thereby avoiding waste of space to a certain extent, and increasing the filling volume of the liquid container during filling. In addition, since the convex portions are disposed on the separation bag, and the separation bag is sleevely disposed on the inner bag, the separation bag will not pile up or fold in a neck of the outer casing due to the inversion of the liquid container during use, but instead, it will stretch as the inner bag stretches and gradually expand to a bottom of the outer casing, which means that the first auxiliary air passages can smoothly extend to a middle or lower portion of the outer casing to ensure the smooth discharge of the gas in order to increase the filling volume of the liquid container.

In one embodiment of the above liquid container, the convex portions are located on an outer surface of the separation bag, and one end of the ventilation structure is in communication with the outside air, and the other end is communicated with an inner cavity of the outer casing. The convex portions can be disposed on the outer surface of the separation bag, thus, the ventilation structure is communicated to the cavity between the outer casing and the separation bag, and the structure can ensure that the gas in the outer casing can be smoothly discharged to the outside along the first auxiliary air passages between the adjacent convex portions in order to increase the filling volume of the liquid container during filling.

In one embodiment of the above liquid container, each of the convex portions comprises a plurality of protrusions arranged in a straight line, a second auxiliary air passage is formed between the two adjacent protrusions, the second auxiliary air passage can communicate with the adjacent first auxiliary air passages, and the first auxiliary air passages and the second auxiliary air passages are crisscross disposed. After the first auxiliary air passages and the second auxiliary air passages are crisscross disposed, an exhaust network is formed on the outer surface of the separation bag. When a certain local position is subjected to a higher air pressure, the high pressure gas can be uniformly and quickly discharged through the crisscross disposed exhaust network, preventing the gas from being discharged untimely and causing the inner bag to be still pressed by the high pressure gas, untimely filling or premature filling stoppage due to misjudgement, further increasing the filling volume of the liquid container during filling.

In one embodiment of the above liquid container, the protrusions are rhombic or triangular or circular and all the protrusions are evenly arranged. The shape of the protrusions can be a common regular shape, such as rhombic, triangular, circular, etc., and the shapes are very convenient to process, easy to shape, the edges are more uniform, and the edges of the first auxiliary air passages and the second auxiliary air passages formed can be ensured to be smoother, and the gas can be smoothly discharged, thereby further increasing the filling volume of the liquid container during filling. In addition, the uniform arrangement of the protrusions can ensure that the gas discharge at various positions in the barrel can reach a more uniform state, and the efficiency of gas discharge is ensured. Moreover, the protrusions of the several shapes can ensure that the contact surface between the outer surface of the separation bag and the inner wall of the outer casing is smaller, and the frictional resistance with the outer casing during the expansion of the separation bag is smaller, and smoother, so that the inner bag filling is smooth.

In one embodiment of the above liquid container, the convex portion comprises an elongated convex strip, and at least one of the convex strips extends from the bag opening of the separation bag to a bottom of the separation bag. The convex portions can also be directly formed by the one convex strip, and the disposition of the convex strips can ensure that the first auxiliary air passages formed are smooth from end to end, and the gas discharge is smooth, thereby increasing the filling volume of the liquid container during filling, and the complete convex strip is easy to process and convenient to shape.

In one embodiment of the above liquid container, an outer surface of the convex strip is in an arc shape and the radius of the arc is smaller than the radius of the outer casing, and a smooth transition is between the convex strips and the outer surface of the separation bag. The outer surface of the convex strip has the arc with the radius smaller than the radius of the outer casing, so that even if the inner bag is stretched to cause the separation bag to fit on the inner surface of the outer casing, the convex strips can be kept in line contact with the inner wall of the outer casing as much as possible rather than in surface contact, further freeing up space for gas circulation, and helping to increase the filling volume of the liquid container during filling.

In one embodiment of the above liquid container, the convex strips are pleated and formed by self-clinging of an inner surface of the separation bag, can also be pleated protrusions directly formed by local self-clinging of the inner surface of the separation bag partially, and the protrusion can be formed by stacking a plurality of continuous pleats to further improve the exhaust effect.

In one embodiment of the above liquid container, the volumes of the separation bag and the inner bag in an unrestricted state are respectively larger than the volume of the outer casing. This structure can ensure that the separation bag and the inner bag can be fitted with each position of the inner surface on the outer casing, that is, all the space inside the outer casing can be further utilized to avoid wasting the space of the outer casing, so as to increase the filling volume of the liquid container during filling.

In one embodiment of the above liquid container, the convex portions are located on the inner surface of the separation bag. One of the ends of the ventilation structure is in communication with the outside air, and the other end is communicated with the inner cavity of the outer casing. At least one of the convex portions extends from the bag opening of the separation bag to the bottom of the separation bag, and the bottom of the separation bag is further disposed with openings extending at least to the convex portions. Of course, the convex portions can also be disposed on the inner surface of the separation bag. By having the openings disposed at the bottom of the separation bag, the present invention ensures that the gas in the outer casing can enter from the openings to outer peripheral sides of the convex portions. Due to the presence of the convex portions, there must be a certain gap between the convex portions, the outer surface of the separation bag, and the inner surface of the outer casing, and therefore the gas can be discharged from the first auxiliary air passages to a ventilation structure along the convex portions and then discharged out of the liquid container, thereby achieving the increase of filling volume of the liquid container during filling.

In one embodiment of the above liquid container, the bag opening of the separation bag and the valve are fixedly connected to each other and form a seal, and the ventilation structure comprises a first venting passage located on the liquid outlet valve. The first venting passage can be directly provided on the liquid outlet valve, so that the various liquid discharge structures and the ventilation structure are more compact, avoiding waste of the inner space of the liquid container, and increasing the filling volume of the liquid container during filling.

Compared with the prior art, some embodiments of the present invention have the following advantages:

1. The convex portions are disposed on the separation bag and it is ensured that the first auxiliary air passages formed between the convex portions can communicate with the ventilation structure, and even if the separation bag is stretched to fit on the inner surface of the outer casing during the filling of the liquid into the inner bag, the ventilation structure is not further blocked. A portion of the gas located in the outer casing can still flow to the ventilation structure along the first auxiliary air passages and be discharged outside the liquid container, so as to ensure that the liquid is not compressed by the high pressure gas and can be further filled into the inner bag, thereby avoiding waste of space to a certain extent, and increasing the filling volume of the liquid container during filling.

2. Since the convex portions are disposed on the separation bag, and the separation bag is sleevely disposed on the inner bag, the separation bag will not pile up or fold in the neck of the outer casing due to the inversion of the liquid container during use, but instead, it will stretch as the inner bag stretches and gradually expand to the bottom of the outer casing, which means that the first auxiliary air passages can smoothly extend to a middle or lower portion of the outer casing to ensure the smooth discharge of the gas in order to increase the filling volume of the liquid container.

3. The openings are provided at the bottom of the separation bag, and the openings can communicate with inner and outer sides of the separation bag to ensure that the gas in the outer casing can be discharged from the first auxiliary air passages to the ventilation structure along the convex portions and then discharged out of the liquid container, thereby achieving the increase of the filling volume of the liquid container during filling.

DETAILED DESCRIPTION OF THE INVENTION

The technical solutions of the present invention are further described below with reference to the specific embodiments of the present invention in conjunction with the accompanied drawings, but the present invention is not limited to these embodiments.

Embodiment 1

Figure 1:
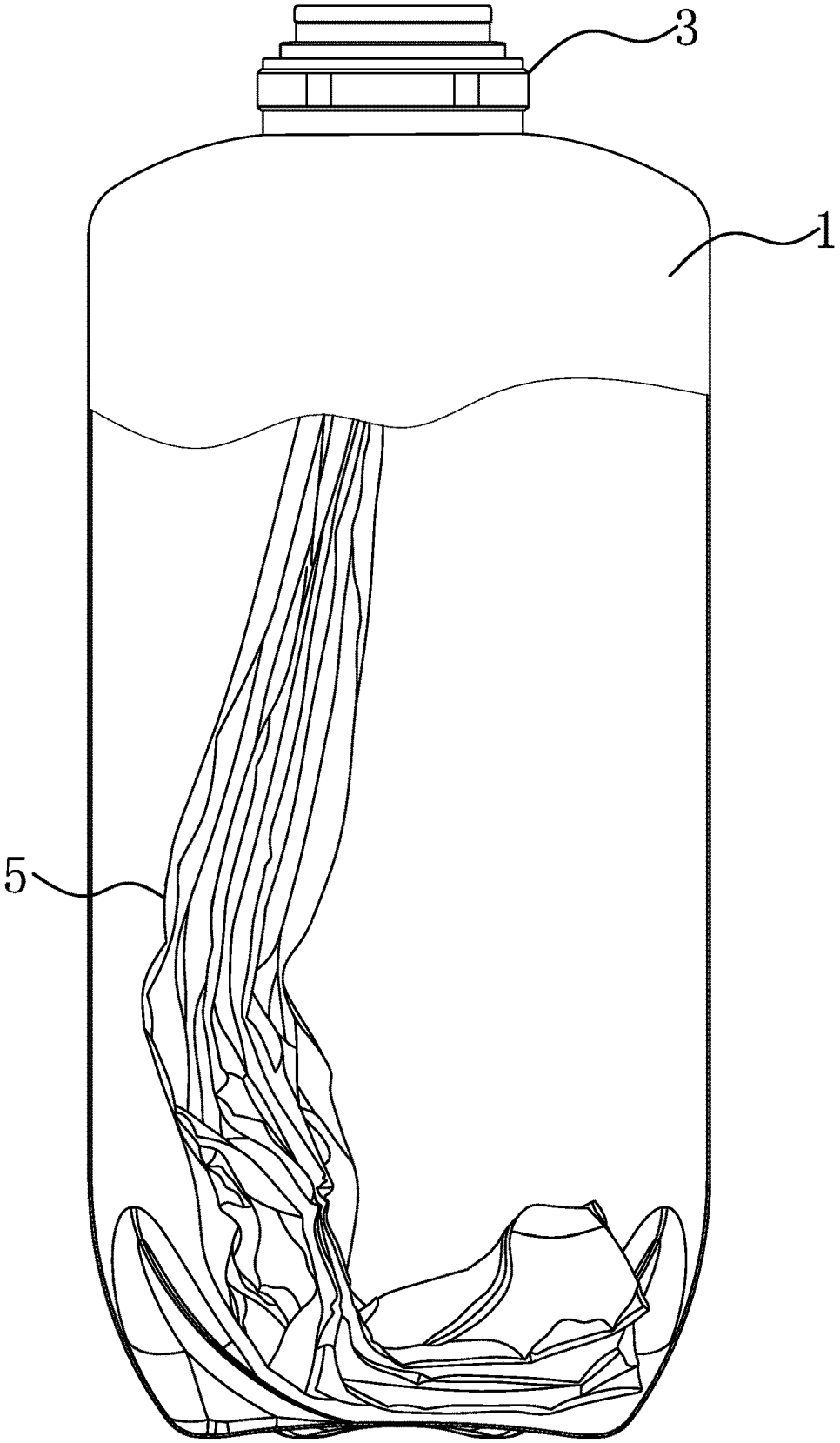
FIG. 1 is a partial cross-sectional view of a liquid container in a first embodiment.
Figure 2:
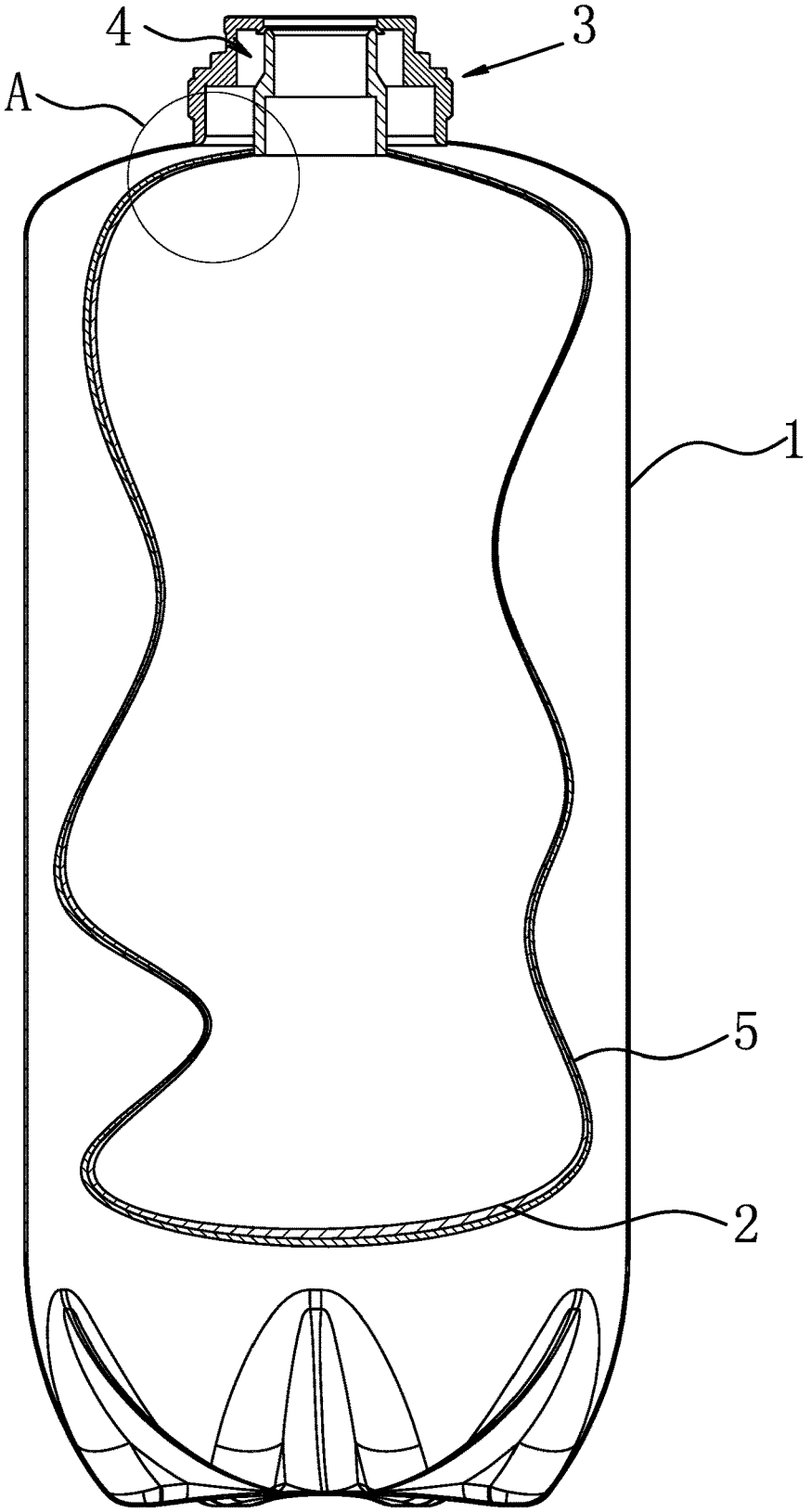
FIG. 2 is a cross-sectional view of the liquid container in the first embodiment with a separation bag in a semi-stretched state.

As shown in FIG. 1 to FIG. 2, one embodiment of a liquid container comprises a barrel-shaped outer casing 1, a flexible gas or liquid tight inner bag 2 disposed in the outer casing 1 for storing fluids, and a valve 3 for controlling the fluid to flow in/out of the inner bag 2. The inner bag 2 is fixedly connected to the valve 3 and a bag opening 21 of the inner bag 2 forms a seal with the valve 3. The outer casing 1 forms a seal with the valve 3, and one end of the outer casing 1 connected to the valve 3 is further connected with a ventilation structure 4 capable of controlling gas to flow in/out of a space between the inner bag 2 and the outer casing 1. The ventilation structure 4 comprises a first venting passage located on the valve 3. The first venting passage 41 can be directly provided on the valve 3, so that the various liquid discharge structures and the ventilation structure 4 are more compact.

Figure 3:
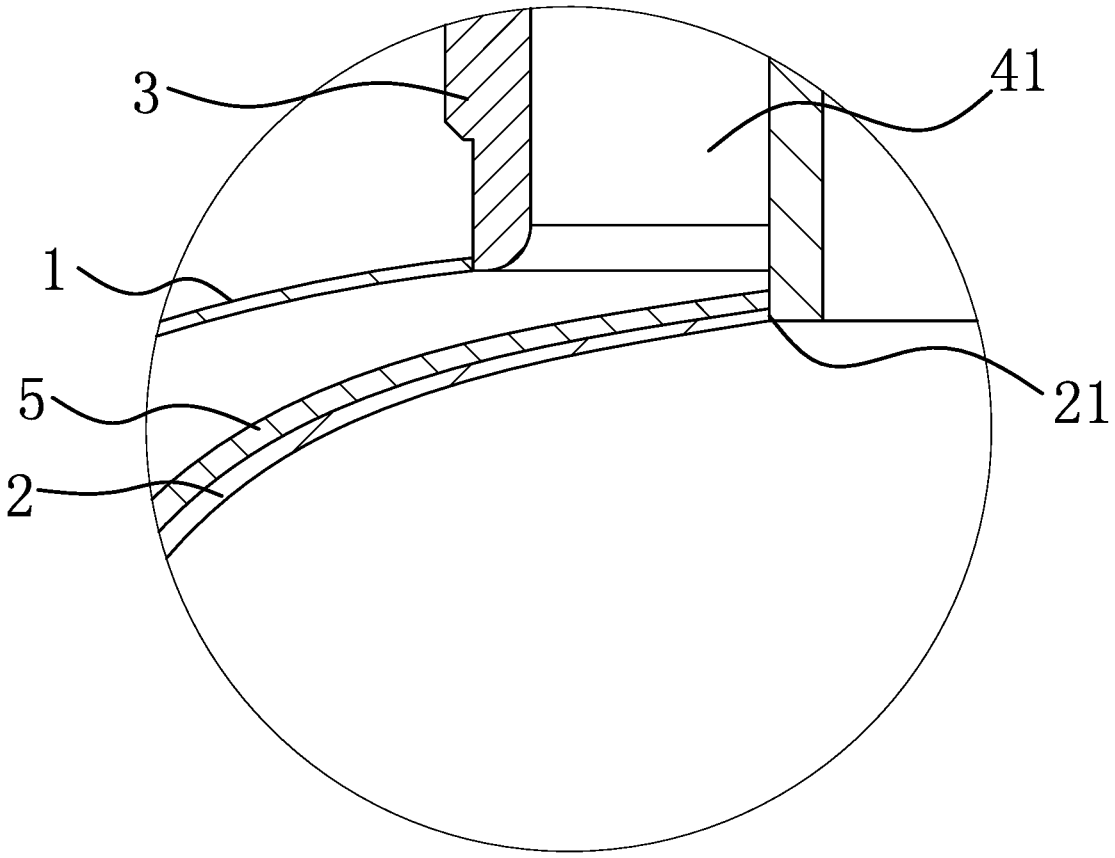
FIG. 3 is an enlarged view of a portion A of FIG. 2.
Figure 4:
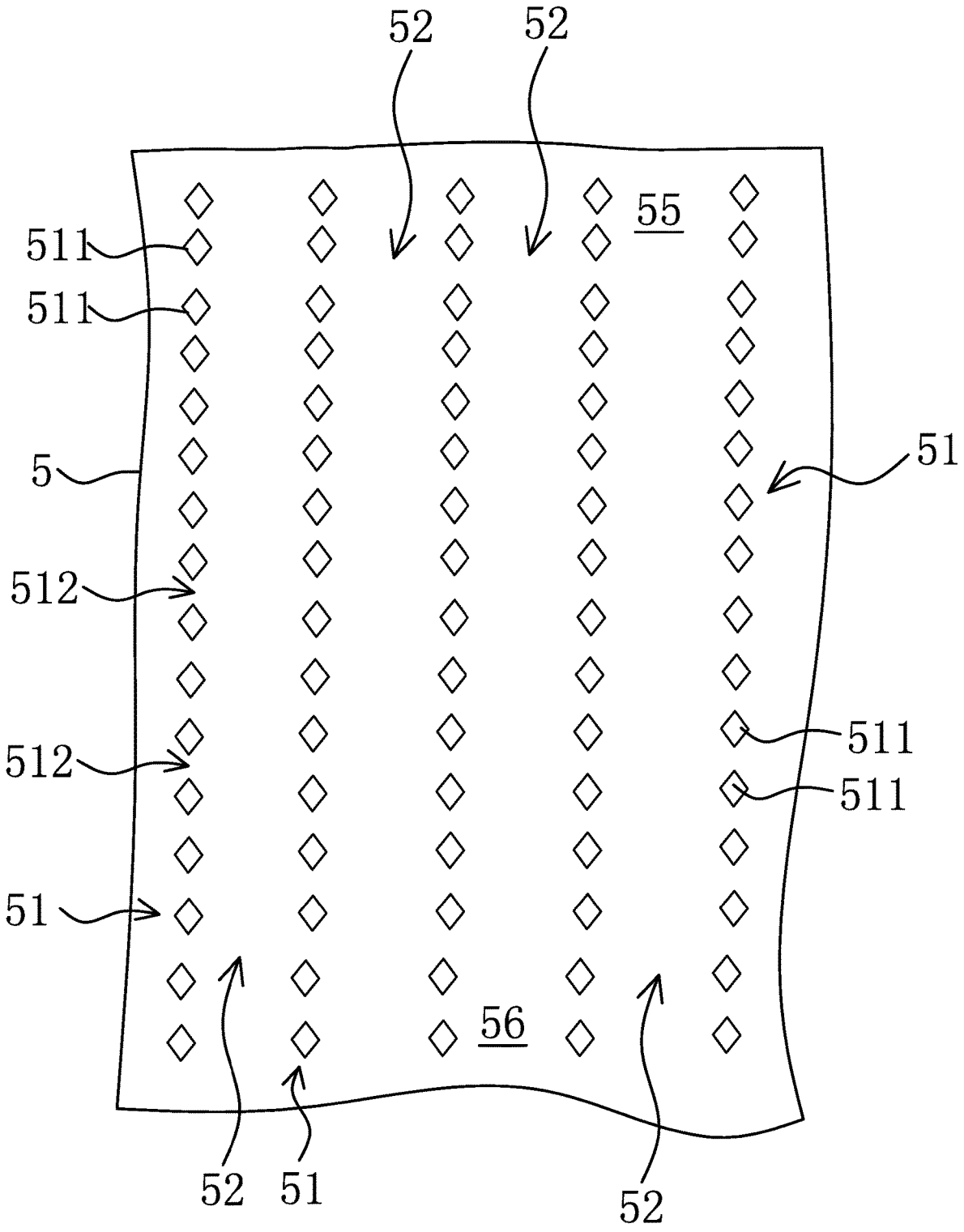
FIG. 4 is a schematic view of the separation bag in the first embodiment.

As shown in FIG. 3 and FIG. 4, one embodiment of a separation bag 5 is further sleevely disposed between the inner bag 2 and the outer casing 1. A bag opening of the separation bag 5 and the valve 3 are fixedly connected to each other and form a seal. Of course, the separation bag 5 also need not be fixedly connected to the valve 3. The separation bag 5 is a flexible bag, preferably a plastic film bag. The separation bag 5 has a plurality of convex portions 51 protruding from a surface of the separation bag 5, and each of the convex portions 51 extends in a direction from a top 55 of the separation bag 5 toward bottom 56 of the separation bag 5. A first auxiliary air passage 52 for gas circulation is formed between the two adjacent convex portions 51, and the first auxiliary air passages 52 are always in communication with the ventilation structure 4.

By separately disposing one embodiment of the flexible separation bag 5 between the outer casing 1 and the inner bag 2, the convex portions 51 can be conveniently processed without affecting the structure and strength of the inner bag 2 itself. In the process of filling the liquid into the inner bag 2, the separation bag 5 is gradually expanded by the inner bag 2 to fit on an inner surface of the outer casing 1. The convex portions 51 are disposed on the separation bag 5 to ensure that the first auxiliary air passages 52 formed between the convex portions 51 can communicate with the ventilation structure 4, and, even if the separation bag 5 is stretched to fit on the inner surface of the outer casing 1, the ventilation structure 4 is not further blocked. A portion of the gas located in the outer casing 1 can still flow to the ventilation structure 4 along the first auxiliary air passages 52 and be discharged outside the liquid container, so as to ensure that the liquid is not compressed by the high pressure gas and can be further filled into the inner bag 2, thereby avoiding waste of space to a certain extent, and increasing the filling volume of the liquid container during filling. Furthermore, the volumes of the separation bag 5 and the inner bag 2 in an unrestricted state are respectively larger than the volume of the outer casing 1. This structure can ensure that the separation bag 5 and the inner bag 2 can be fitted with each position on the inner surface of the outer casing 1, that is, all the space inside the outer casing 1 can be further utilized to avoid wasting the space of the outer casing 1, so as to increase the filling volume of the liquid container during filling. In this embodiment, it is preferable to have the inner surface of the separation bag 5 and the outer surface of the inner bag 2 fitted with each other, or to form a vacuum between the separation bag 5 and the inner bag 2, so as to avoid the air between the two to take up a certain amount of filling space.

As shown in FIG. 4, the convex portions 51 of one embodiment of the present invention are located on the outer surface of the separation bag 5, one end of the ventilation structure 4 is in communication with the outside air, and the other end is communicated with an inner cavity of the outer casing 1. The convex portions 51 can be disposed on the outer surface of the separation bag 5, such that the ventilation structure 4 is communicated to the cavity between the outer casing 1 and the separation bag 5, and this structure can ensure that the gas in the outer casing 1 can be smoothly discharged to the outside along the first auxiliary air passages 52 between two adjacent convex portions 51 in order to increase the filling volume of the liquid container during filling. Specifically, each of the convex portions 51 comprises a plurality of protrusions 511 arranged in a straight line, a second auxiliary air passage 512 is formed between the two adjacent protrusions 511, the second auxiliary air passage 512 can communicate with the adjacent first auxiliary air passages 52, and the first auxiliary air passages 52 and the second auxiliary air passages 512 are crisscross disposed. After the first auxiliary air passages 52 and the second auxiliary air passages 512 are crisscross disposed, an exhaust network is formed on the outer surface of the separation bag 5. When a certain local position is subjected to a higher air pressure, the high pressure gas can be uniformly and quickly discharged through the crisscross disposed exhaust network, preventing the gas from being discharged untimely and causing the inner bag 2 still to be pressed by the high pressure gas, untimely filling or premature filling stoppage due to misjudgement, further increasing the filling volume of the liquid container during filling.

In one embodiment of the present invention, the shape of the protrusion 511 is preferably rhombic and all the protrusions 511 are evenly arranged. The shape is very convenient to process, easy to shape, the edges are more uniform, and the edges of the first auxiliary air passages 52 and the second auxiliary air passages 512 formed can be ensured to be smoother, and the gas can be smoothly discharged, thereby further increasing the filling volume of the liquid container during filling. In addition, the uniform arrangement of the protrusions 511 can ensure that the gas discharge at various positions in the barrel can reach a more uniform state, and the efficiency of gas discharge is ensured. In this embodiment, the thickness at various positions of the entire separation bag 5 can be made nearly equal, that is, corresponding concave portions are formed on the inner surface opposite to the protrusions 511 on the outer surface. Of course, the thickness of the entire separation bag 5 can also be made unequal, so that the separation bag 5 has a thicker thickness at the protrusions 511.

When in use, one embodiment of the liquid container is inverted and liquid is filled into the inner bag 2, as the liquid is continuously filled into the inner bag 2, under the gravitational effect of the liquid, the inner bag 2 and the separation bag 5 at the position of a barrel opening of the liquid container are first expanded and attached to the inner wall of the outer casing 1. As more and more of the liquid is being filled, the gas originally present between the separation bag 5 and the outer casing 1 is further discharged to the outside of the liquid container through the first auxiliary air passages 52 communicated with the ventilation structure 4 on the valve 3.

Embodiment 2

Figure 5:
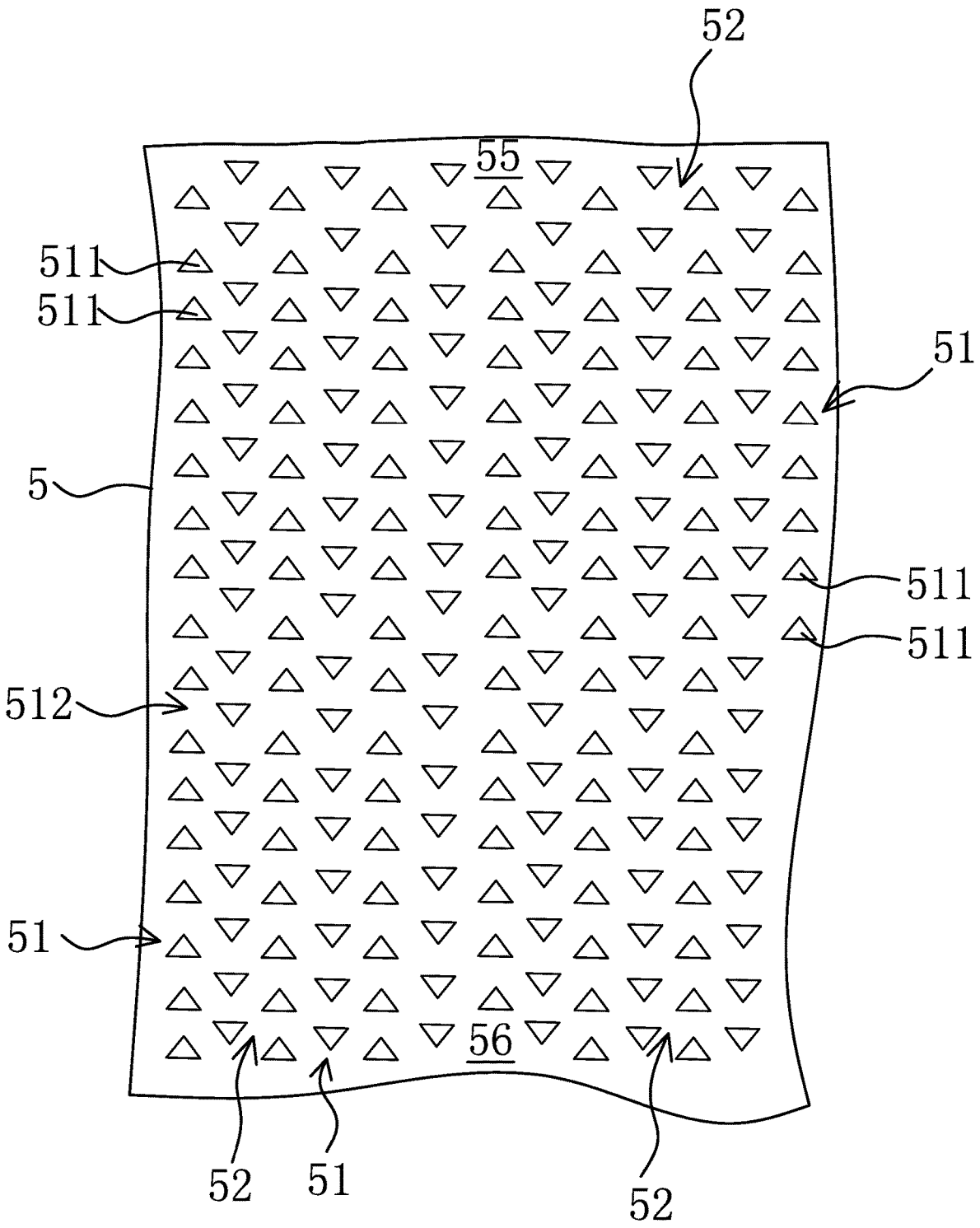
FIG. 5 is a schematic view of the separation bag in a second embodiment.

The structure and principle of this embodiment are basically the same as those of the first embodiment, and the difference lie in: as shown in FIG. 5, the shape of the protrusions 511 is triangular, the triangular protrusion 511 is also very convenient to process, easy to shape, the edges are more uniform, and the edges of the first auxiliary air passages 52 and the second auxiliary air passages 512 formed can be ensured to be smoother, and the gas can be smoothly discharged.

Embodiment 3

Figure 6:
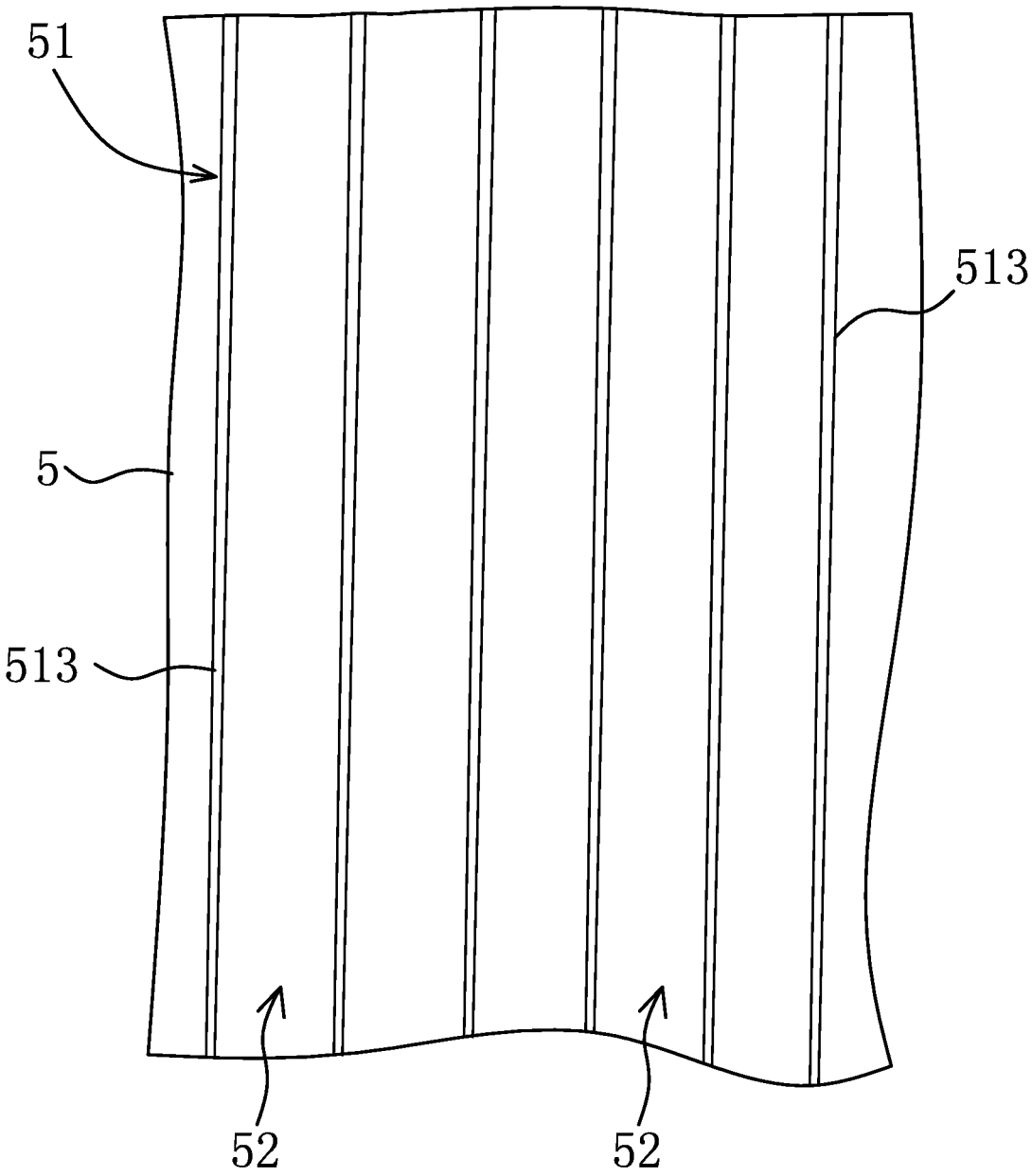
FIG. 6 is a schematic view of the separation bag in a third embodiment.
Figure 7:
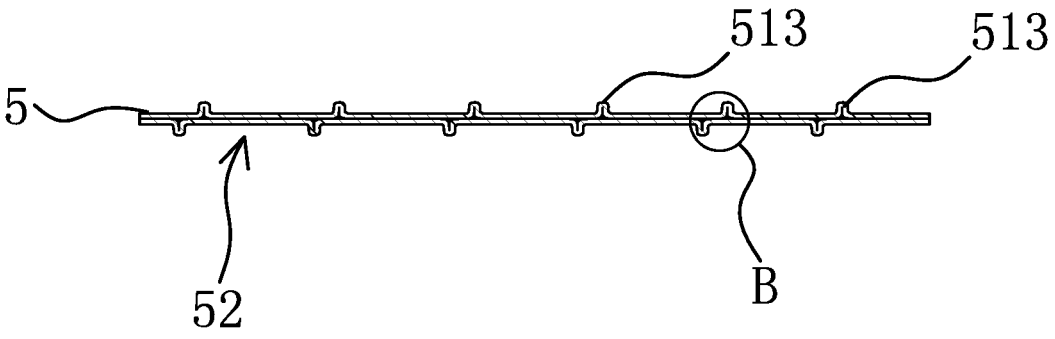
FIG. 7 is a cross-sectional view of the separation bag in the third embodiment.
Figure 8:
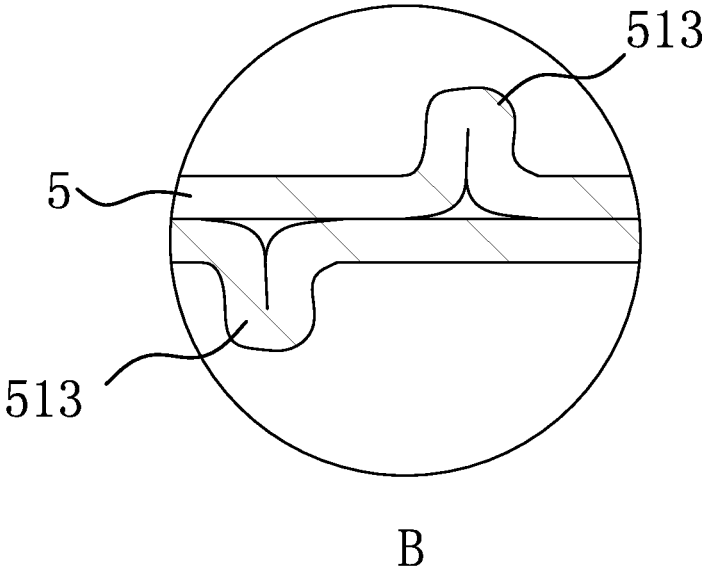
FIG. 8 is an enlarged view of a portion B of FIG. 7.

The structure and principle of this embodiment are basically the same as those of the first embodiment, and the difference lie in: as shown in FIG. 6 to FIG. 8, the convex portion 51 comprises an elongated convex strip 513, and at least one of the convex strips 513 extends from the bag opening of the separation bag 5 to a bottom of the separation bag 5. The disposition of the convex strips 513 can ensure that the first auxiliary air passages 52 formed are smooth from end to end, and that the gas discharge is smooth, thereby increasing the filling volume of the liquid container during filling. And the complete convex strip 513 is easy to process and convenient to shape. Specifically, the convex strips 513 are pleated and formed by self-clinging of the inner surface of the separation bag 5, that is, the pleated protrusions 511 directly formed by local self-clinging of the inner surface of the separation bag 5 partially, and the protrusion 511 can be formed by stacking a plurality of continuous pleats to further improve the exhaust effect.

Embodiment 4

The structure and principle of the embodiment are basically the same as those of the third embodiment, and the difference lie in: an outer surface of the convex strip 513 is in an arc shape and the radius of the arc is smaller than the radius of the outer casing 1, and a smooth transition is between the convex strips 513 and the outer surface of the separation bag 5. The outer surface of the convex strip 513 has the arc with the radius smaller than the radius of the outer casing 1, so that even if the inner bag 2 is stretched to cause the separation bag 5 to fit on the inner surface of the outer casing 1, the convex strips 513 can be kept in line contact with the inner wall of the outer casing 1 as much as possible rather than in surface contact, further freeing up space for gas circulation, and helping to increase the filling volume of the liquid container during filling.

Embodiment 5

Figure 9:
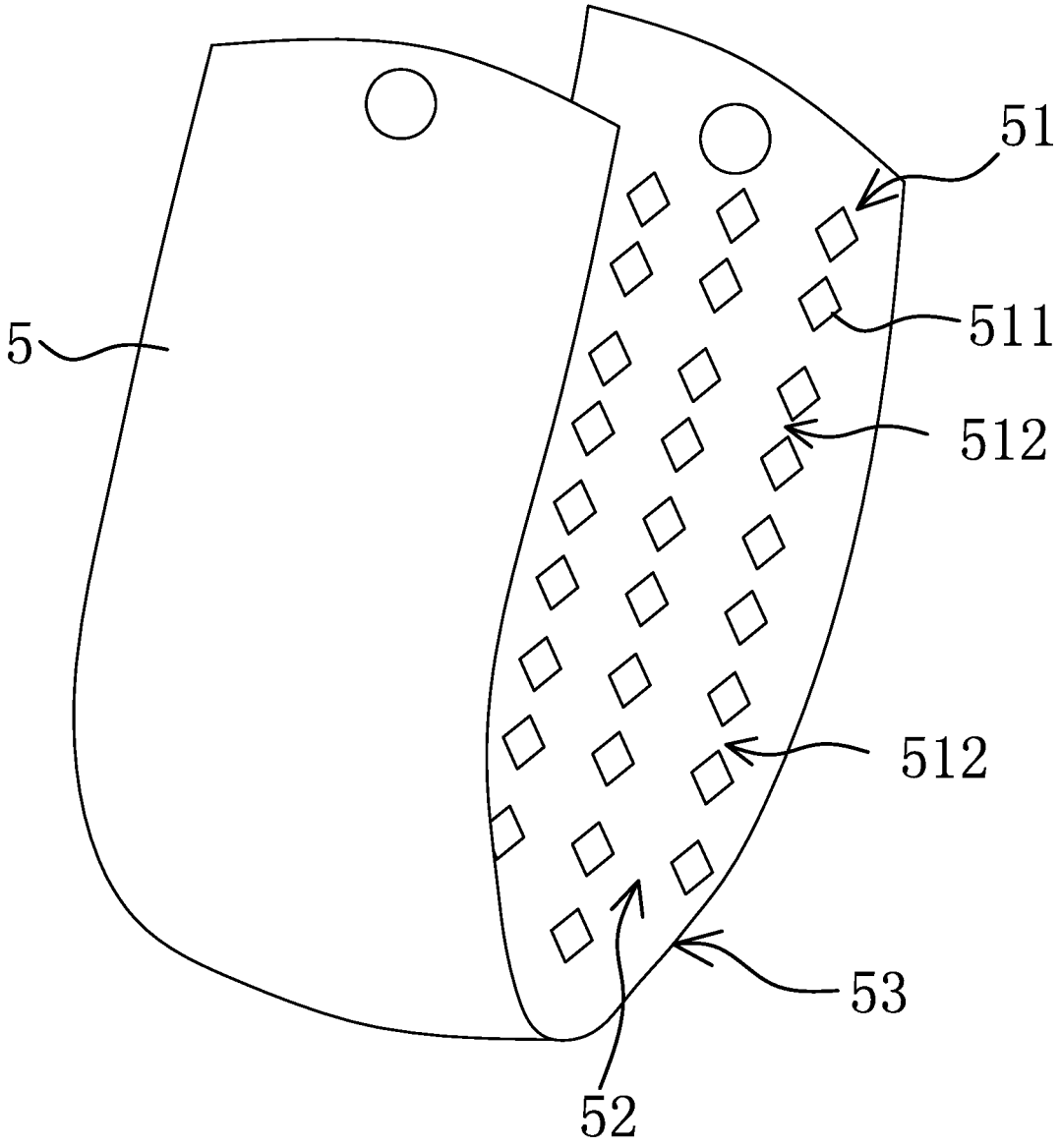
FIG. 9 is a schematic view of the separation bag in a fifth embodiment.

The structure and principle of this embodiment are basically the same as those of the first embodiment, and the difference lie in: as shown in FIG. 9, the convex portions 51 are located on the inner surface of the separation bag 5, one end of the ventilation structure 4 is in connection with the outside air, and the other end is communicated with an inner cavity of the outer casing 1. At least one of the convex portions 51 extends from the bag opening of the separation bag 5 to the bottom of the separation bag 5. The bottom of the separation bag 5 is further provided with openings 53 extending to the convex portions 51. The number of the openings 53 is two and extend up to the top 55 of the separation bag 5. By having the openings 53 disposed at the bottom of the separation bag 5, the present invention ensures that the gas in the outer casing 1 can enter from the openings 53 to outer peripheral sides of the convex portions 51, and then the gas can be discharged from the first auxiliary air passages 52 to a ventilation structure along the convex portions 51 and then discharged out of the liquid container, thereby achieving the increase of filling volume of the liquid container during filling.

Embodiment 6

Figure 10:
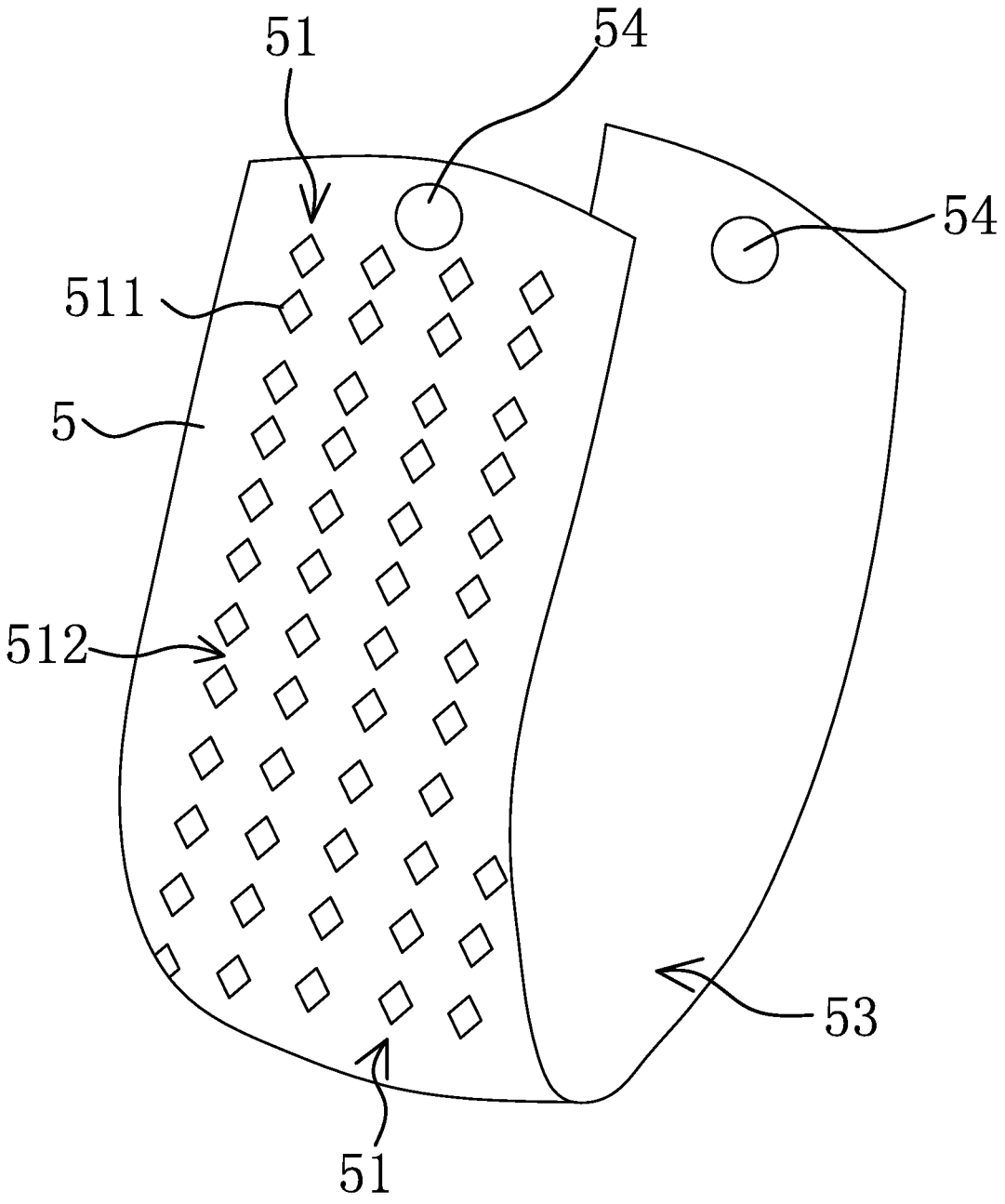
FIG. 10 is a schematic view of the separation bag in a sixth embodiment.

The structure and principle of this embodiment are basically the same as those of the first embodiment, and the difference lie in: as shown in FIG. 10, the bottom of the separation bag 5 is further provided with the openings 53 extending to the top 55 of the separation bag 5. The number of the openings 53 is two and are respectively located at two opposite sides of the separation bag 5, and a hanging hole 54 is further provided at the top 55 on both sides of the separation bag 5. The separation bag 5 is hung on the inner bag 2 through the hanging holes 54 and connected to the inner bag 2.

Embodiment 7

Figure 11:
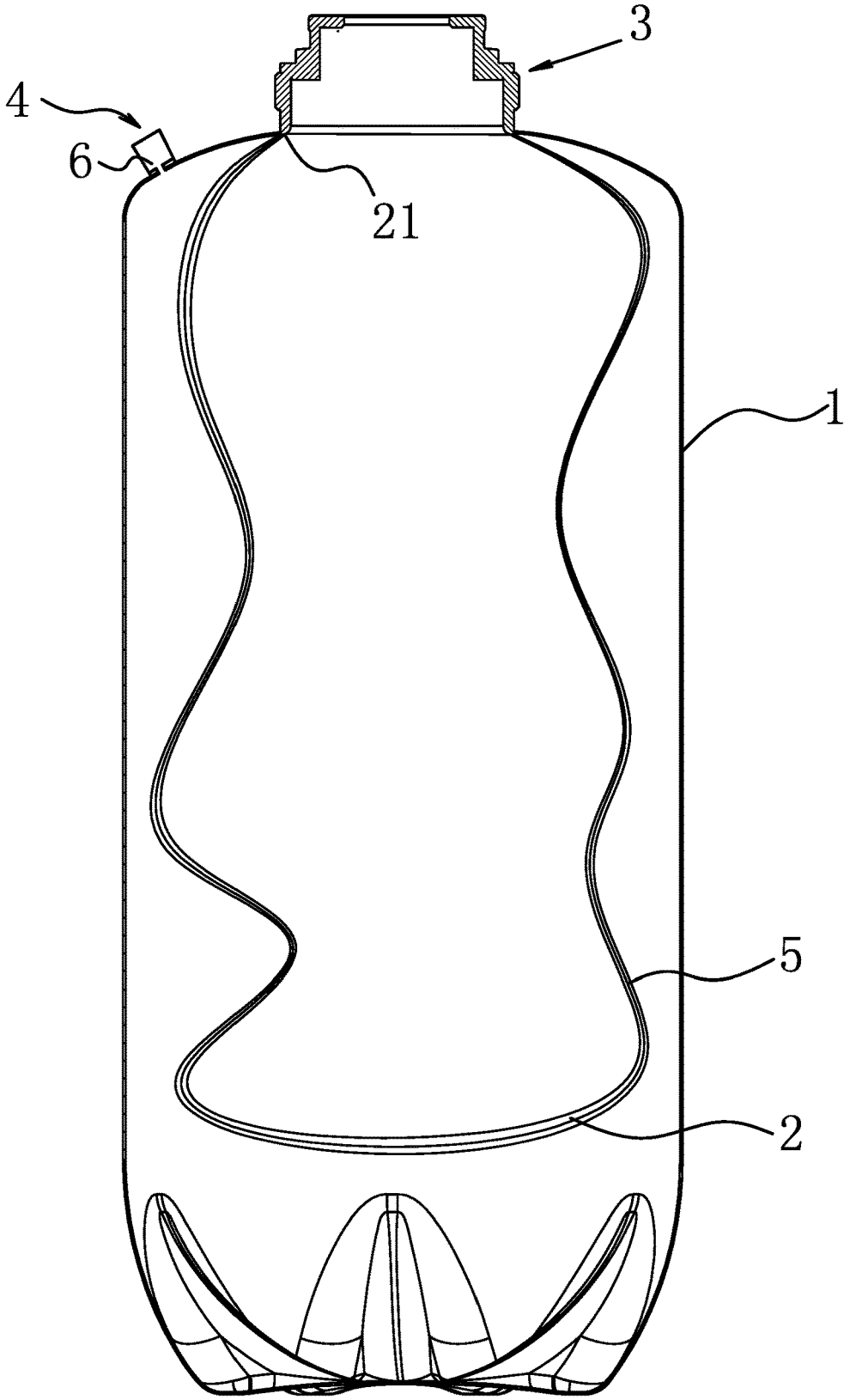
FIG. 11 is a cross-sectional view of a liquid container with a gas valve in the seventh embodiment.

The structure and principle of this embodiment are basically the same as those of the first embodiment, and the difference lie in: as shown in FIG. 11, an inlet and outlet air valve 6 is fixedly connected to the outer casing 1, and a seal is formed between the inlet and outlet air valve 6 and the outer casing 1. The ventilation structure is a second venting passage disposed on the inlet and outlet air valve 6.

The specific embodiments described herein are merely illustrative of the scope of the invention. A person skilled in the art can make various modifications or additions to the specific embodiments described or replace them in a similar manner, without departing from the spirit of the invention or beyond the scope defined by the appended claims.

Although the terms outer casing 1, inner bag 2, valve 3, ventilation structure 4, separation bag 5, and the like are used a lot herein, the possibility of using other terms is not excluded. These terms are merely used to describe and explain the nature of the invention more conveniently; construing them as any of the additional restrictions is contrary to the scope of the present invention.

LIST OF REFERENCED PARTS

1 outer casing
2 inner bag
21 bag opening
3 valve
4 ventilation structure
41 first venting passage
5 separation bag
6 gas valve
51 convex portions
511 protrusions
512 second auxiliary air passages
513 convex strips
52 first auxiliary air passages
53 openings
54 hanging holes
55 top of the separation bag
56 bottom of the separation bag

What is claimed is:

1. A container for fluids, comprising:

an outer casing;

a flexible gas tight or liquid tight inner bag disposed in the outer casing, the inner bag capable of storing fluids;

a valve fixedly connected to the inner bag, the valve capable of controlling fluids to flow in or out of the inner bag, the valve connected to the outer casing to form a seal with the outer casing;

a ventilation structure arranged in the valve or on the outer casing, the ventilation structure capable of controlling gas to flow in or out of a space between the inner bag and the outer casing;

a flexible separation bag capable of venting gas sleevely disposed on an outer surface of the inner bag, the separation bag disposed between the inner bag and the outer casing;

a plurality of convex portions protruding from a surface of the separation bag, each of the convex portions extending in a direction from a top of the separation bag toward a bottom of the separation bag; and first auxiliary air passages are formed between two adjacent convex portions, the first auxiliary air passages capable of allowing gas circulation, and the first auxiliary air passages are always in communication with the ventilation structure;

wherein the separation bag is provided with openings capable of venting gas.

2. The liquid container as claimed in claim 1, wherein the convex portions are located on an outer surface of the separation bag, a first end of the ventilation structure is in communication with outside air, and a second end of the ventilation structure is connected with an inner cavity of the outer casing.

3. The liquid container as claimed in claim 2, wherein each of the convex portions comprises a plurality of protrusions arranged in a straight line, second auxiliary air passages are formed between two adjacent protrusions, the second auxiliary air passages capable of communicating with the adjacent first auxiliary air passages, and the first auxiliary air passages and the second auxiliary air passages are crisscrossedly disposed.

4. The liquid container as claimed in claim 3, wherein the protrusions are rhombic, triangular, or circular, and all the protrusions are evenly arranged.

5. The liquid container as claimed in claim 2, wherein the convex portions comprise elongated convex strips, and at least one of the convex strips extends from the top of the separation bag to the bottom of the separation bag.

6. The liquid container as claimed in claim 5, wherein an outer surface of at least one of the convex strips is in an arc shape and a radius of the arc is smaller than a radius of the outer casing, and a smooth transition is between the convex strips and the outer surface of the separation bag.

7. The liquid container as claimed in claim 5, wherein the convex strips are pleated and formed by self-clinging of an inner surface of the separation bag.

8. The liquid container as claimed in claim 1, wherein volumes of the separation bag and the inner bag in an unrestricted state are larger than a volume of the outer casing.

9. The liquid container as claimed in claim 1, wherein the convex portions are located on an inner surface of the separation bag, a first end of the ventilation structure is in communication with outside air, and a second end of the ventilation structure is communicated with an inner cavity of the outer casing, at least one of the convex portions extends from the top of the separation bag to the bottom of the separation bag, and the bottom of the separation bag is further disposed with openings extending at least to the convex portions.

10. The liquid container as claimed in claim 2, wherein the bag opening of the separation bag and the valve are fixedly connected to each other and form a seal, and the ventilation structure comprises a first venting passage located on the liquid outlet valve.

* * * * *